US009307834B2

(12) United States Patent
Han

(10) Patent No.: US 9,307,834 B2
(45) Date of Patent: Apr. 12, 2016

(54) VERTICAL FRAME FOR DISPLAY STAND AND MULTIPURPOSE PREFABRICATED DISPLAY STAND USING SAME

(71) Applicant: Jae Wook Han, Seoul (KR)

(72) Inventor: Jae Wook Han, Seoul (KR)

( * ) Notice: Subject to any disclaimer, the term of this patent is extended or adjusted under 35 U.S.C. 154(b) by 0 days.

(21) Appl. No.: 14/437,382

(22) PCT Filed: Oct. 22, 2013

(86) PCT No.: PCT/KR2013/009442
§ 371 (c)(1),
(2) Date: Apr. 21, 2015

(87) PCT Pub. No.: WO2014/065574

PCT Pub. Date: May 1, 2014

(65) Prior Publication Data

US 2015/0257531 A1 Sep. 17, 2015

(30) Foreign Application Priority Data

Oct. 22, 2012 (KR) ..... 10-2012-0117366

(51) Int. Cl.
*A47B 47/00* (2006.01)
*A47B 87/02* (2006.01)
(Continued)

(52) U.S. Cl.
CPC ..... *A47B 47/0091* (2013.01); *A47B 47/04* (2013.01); *A47B 87/0207* (2013.01); *A47B 87/0246* (2013.01); *A47B 96/024* (2013.01); *A47B 96/145* (2013.01)

(58) Field of Classification Search
CPC ..... A47B 96/145; A47B 47/0091; A47B 87/0207; A47B 87/00; A47B 87/007; A47B 87/008; A47B 87/02; A47B 87/0215; A47B 87/0223; A47B 87/0246; A47B 87/0276; A47B 87/0284; A47B 96/14; A47B 96/024; A47B 96/06; A47B 87/0292; A47B 47/00; A47B 47/0083; A47B 47/02; A47B 47/021; A47B 47/045; A47B 47/047; A47B 47/04
USPC ..... 211/186, 187, 182, 188, 194, 183, 190, 211/191; 108/107, 111; 403/292, 231, 380, 403/165, DIG. 11, 348, 349, 353
See application file for complete search history.

(56) References Cited

U.S. PATENT DOCUMENTS 3,834,549 A * 9/1974 Burg et al. ..... 211/189
4,066,370 A * 1/1978 Van Driessche ..... F16B 12/46 403/217

(Continued)

FOREIGN PATENT DOCUMENTS

JP 3150406 4/2009
KR 2019910005408 4/1991

(Continued)

*Primary Examiner* — Joshua Rodden
*Assistant Examiner* — Hiwot Tefera
(74) *Attorney, Agent, or Firm* — IPLA P.A.; James E. Bame

(57) ABSTRACT

A vertical frame for a display stand to store and display various articles is manufactured in the shape of a prefabricated block, and then is assembled in multiple stages. The vertical frame includes a body which is formed in a shape of a prefabricated block and is assembled to each other in multiple stages to support a shelf, a vertical length of the body being optionally adjusted by selection of a user; a body engaging member which protrudes upwardly from both sides or one side of a top surface of the body, and has an insertion groove of which one side is opened; a body engaging groove which is formed on a bottom surface of the body at a position corresponding to a formation position of the body engaging member, so as to guide the body engaging member and a body locking boss to an engaging position; and the body locking boss which protrudes from the body engaging groove and is fitted into the insertion groove when the bodies are assembled to each other in multiple stages.

1 Claim, 5 Drawing Sheets

(51) Int. Cl.

| | |
|---|---|
| ***A47B 96/02*** | (2006.01) |
| ***A47B 96/14*** | (2006.01) |
| ***A47B 47/04*** | (2006.01) |

(56) References Cited

U.S. PATENT DOCUMENTS

| | | | | | |
|---|---|---|---|---|---|
| 4,493,425 | A * | 1/1985 | Yoshida | 211/189 | |
| 4,797,021 | A * | 1/1989 | Stamper | 403/165 | |
| 5,048,702 | A * | 9/1991 | Maloney | B62B 3/006 | 211/194 |
| 5,172,817 | A * | 12/1992 | Gross | 211/40 | |
| 5,481,842 | A * | 1/1996 | Gautreau | 52/656.9 | |
| 5,499,885 | A * | 3/1996 | Chapman | 403/380 | |
| 5,715,956 | A * | 2/1998 | Yoshida | 211/182 | |
| 5,904,420 | A * | 5/1999 | Dedoes | B01F 7/1695 | 108/151 |
| 6,044,990 | A * | 4/2000 | Palmeri | 211/189 | |
| 6,644,966 | B1 * | 11/2003 | Chiang | F27D 5/0012 | 432/253 |
| 8,133,049 | B1 * | 3/2012 | Sullivan et al. | 432/258 | |
| 8,157,470 | B2 * | 4/2012 | De Wilde | 403/348 | |
| 8,955,928 | B2 * | 2/2015 | Cheng | 312/265.2 | |
| 2003/0089829 | A1 * | 5/2003 | Brandzel et al. | 248/68.1 | |
| 2007/0068882 | A1 * | 3/2007 | Yoshizawa | B65D 85/38 | 211/41.18 |
| 2008/0302748 | A1 * | 12/2008 | Tsai | 211/188 | |
| 2011/0100938 | A1 * | 5/2011 | Scadden et al. | 211/59.4 | |
| 2012/0009013 | A1 * | 1/2012 | Evitt | 403/349 | |
| 2012/0163954 | A1 * | 6/2012 | Yoshida | 414/802 | |
| 2012/0235004 | A1 * | 9/2012 | Belyea et al. | 248/345.1 | |
| 2014/0020322 | A1 * | 1/2014 | Li | A47B 47/04 | 52/588.1 |
| 2014/0270918 | A1 * | 9/2014 | Simmons | 403/205 | |

FOREIGN PATENT DOCUMENTS

| | | |
|---|---|---|
| KR | 2019950032085 | 12/1995 |
| KR | 2003341800000 | 11/2003 |

* cited by examiner

VERTICAL FRAME FOR DISPLAY STAND AND MULTIPURPOSE PREFABRICATED DISPLAY STAND USING SAME

BACKGROUND

The present invention relates to a vertical frame for a display stand and a multipurpose prefabricated display stand using the same and, more specifically, to a vertical frame for a display stand to store and display various articles thereon, in which the vertical frame is manufactured in the shape of a prefabricated block, and then is assembled to each other in multiple stages, thereby improving the assembly thereof, and a multipurpose prefabricated display stand using the same.

A prefabricated hyper-angle display stand according to the related art is disclosed in Korean Utility Model Publication No. 20-0334180 (Nov. 13, 2003), wherein assembling and disassembling work thereof are easy, a manufacturing process is simplified, and the configuration is strong. The prefabricated hyper-angle display stand includes posts formed with a plurality of insertion grooves on a side thereof, fixing beams connected between the posts as a horizontal beam and provided on a side thereof with a plurality of hooks corresponding to the insertion grooves, and base plates positioned on the fixing beams.

According to the related art, a vertical interval of the base plates positioned on the fixing beams can be adjusted at random by the plurality of insertion grooves formed on the side of the posts. However, in the case of the posts serving as a vertical frame of the prefabricated display stand, since the overall height of the display stand to be assembled is determined and manufactured in advance to correspond to the overall height of the display stand, there is a problem in that a user cannot optionally adjust the interval of the display stands. Also, since the post is made by a metal material to have a height of about 2 meters, the post is heavy, and its appearance is long and crude, so that it is difficult to transfer the disassembled posts.

In addition, according to the display stand of the related art, since the fixing beams are fixed to the posts by separate coupling pins in the state in which the fixing beams, on which the base plates are positioned, are engaged to the plurality of insertion grooves formed on the sides of the posts by the hooks, the whole structure of the prefabricated display stand is very complicated, and thus it is difficult to assemble the display stand. Also, since the number of parts for the display stand is increased, the manufacture cost of the prefabricated display stand is raised, and its selling price is also increased, which takes a big load on a consumer.

SUMMARY OF THE INVENTION

Accordingly, the present invention has been made in view of the above-mentioned problems occurring in the related art, and an object of the present invention is to provide a vertical frame for a display stand to store and display various articles thereon, wherein a body of the vertical frame is manufactured in the shape of a prefabricated block, and then is assembled to each other in multiple stages by mutually engaging a body engaging member which is formed on a top surface of the body and a body locking boss which is formed on a bottom surface of the body, thereby optionally adjusting a vertical height of the prefabricated display stand and an interval of the shelves, as well as easily transporting parts of the disassembled display stand, and a multipurpose prefabricated display stand using the same.

Also, another object of the present invention is to simplify the engaging structure of vertical frames and shelves by forming shelf engaging grooves so that a frame of the shelf is inserted and fixed to a top surface of a body of the vertical frame, thereby providing a display stand with advantages in which the display stand can be easily assembled, the number of parts for the display stand can be remarkably reduced, and a manufacture cost thereof can be lowered.

To accomplish the above-mentioned object, according to a first aspect of the present invention, there is provided a vertical frame for a display stand that supports shelves installed to store and display various articles thereon, including: a body which is formed in a shape of a prefabricated block and is assembled to each other in multiple stages to support a shelf, a vertical length of the body being optionally adjusted by selection of a user; a body engaging member which protrudes upwardly from both sides or one side of a top surface of the body, and has an insertion groove of which one side is opened; a body engaging groove which is formed on a bottom surface of the body at a position corresponding to a formation position of the body engaging member, so as to guide the body engaging member and a body locking boss to an engaging position; and the body locking boss which protrudes from the body engaging groove and is fitted into the insertion groove when the bodies are assembled to each other in multiple stages, thereby fixing the respective bodies to be assembled to each other in multiple stages.

With the above-described configuration of the present invention, the body of the vertical frame is manufactured in the shape of the prefabricated block, and then is assembled in multiple stages by mutually engaging the body engaging member which is formed on the top surface of the body and the body locking boss which is formed on the bottom surface of the body, thereby optionally adjusting the vertical height of the prefabricated display stand and the interval of the shelves, as well as easily transporting parts of the disassembled display stand, and a multipurpose prefabricated display stand using the same.

Also, since, the engaging structure of vertical frames and shelves are very simple, the display stand has advantages in which the display stand can be easily assembled, the number of parts for the display stand can be remarkably reduced, and a manufacture cost thereof can be lowered.

DETAILED DESCRIPTION OF THE INVENTION

Hereinafter, a vertical frame for a display stand according to embodiments of the present invention and a multipurpose prefabricated display stand using the same will be described in detail with reference to the accompanying drawings.

Figure 1:
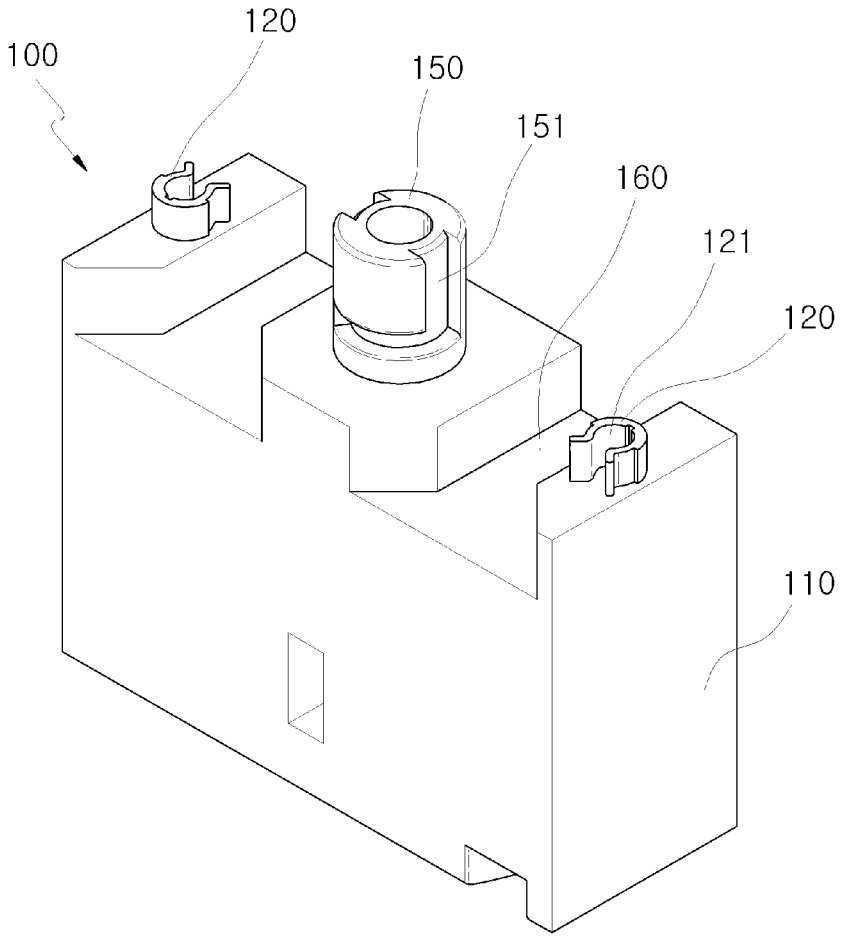
FIG. 1 is a perspective view of a vertical frame for a display stand according to the present invention.
Figure 2:
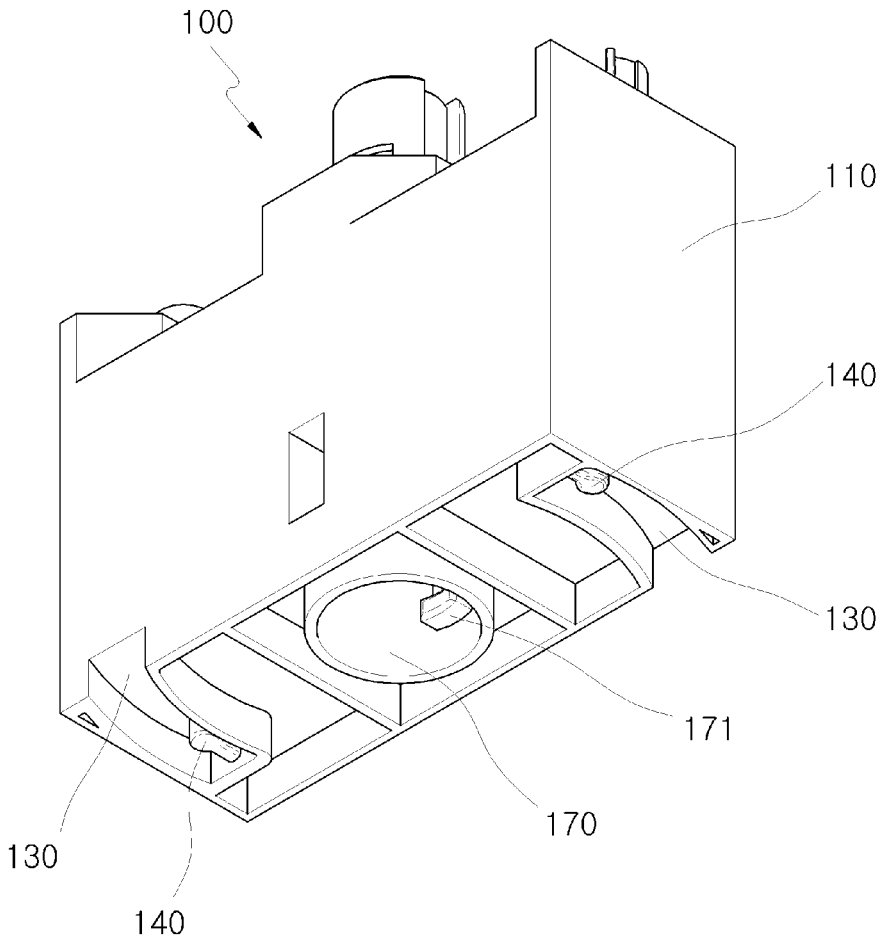
FIG. 2 is a perspective view illustrating a bottom surface of the vertical frame for the display stand according to the present invention.

FIGS. 1 and 2 are views illustrating the vertical frame for the display stand according to the present invention.

A vertical frame 100 for the display stand that supports shelves 200 configured to store and display various articles thereon includes a body 110 formed in a shape of a prefabricated block and assembled in multiple stages to support the shelf 200, a vertical length of the body being optionally adjusted by selection of a user; a body engaging member 120 protruding upwardly from both sides or one side of a top surface of the body 110, and having an insertion groove 121 of which one side is opened; a body engaging groove 130 formed on a bottom surface of the body at a position corresponding to the position at which the body engaging member 120 is formed, so as to guide the body engaging member 120 and a body locking boss 140 to an engaging position; and the body locking boss 140 protruding from the body engaging groove 130 and fitted into the insertion groove 121 when the bodies 110 are assembled in the multiple stages, thereby fixing the respective bodies 110 to be assembled in the multiple stages.

The respective components of the present invention will now be described in detail.

First, the body 110 is configured to assemble the selves 200 of the display stand 1 to be installed to store and display various articles thereon and support the whole load of the display stand 1. The body 110 is made of synthetic resin or light metal material, such as aluminum, and is shaped in a box. The block 110 has a multistage structure of a prefabricated block type so that a plurality of the bodies 110 is stacked in a vertical direction by a user. With the above structure, the shelves 200 can be respectively engaged to the bodies 110 in multiple layers between the vertical frames 100 which are assembled in the multistage state.

The body 110 can be manufactured to have various vertical lengths that can be selected by the user. Since the body 110 can be manufactured to have various vertical lengths of 5 to 30 cm, the bodies 110 are engaged to the selves 200 stacked in the multiple layers, thereby freely adjusting the vertical interval of the shelf 200.

The top surface of the body 110 is provided with a shelf engaging groove 160 at one side or both sides thereof, and a horizontal frame 210 of the shelf 200 is fitted into the engaging groove 160, thereby fixing the shelf. The shelf engaging groove 160 is recessed in the body 110 to correspond to a shape of the horizontal frame 210 of the shelf 200, and thus the shelf 200 is engaged and fixed between the vertical frames 100 to be assembled in multiple stages. If the shelf engaging groove 160 is formed at both sides on the top surface of the body 110, the prefabricated display stands 1 can be extended in a horizontal direction by respectively engaging the shelves 200 to both shelf engaging grooves 160.

The body engaging member 120, the body engaging groove 130 and the body locking boss 140 are formed integrally with the body 110 so as to fix the vertical frames 100 to be assembled in multiple stages. The body engaging member 120 is formed in a C-shape, and protrudes upwardly from the top surface of the body 110 at one side or both sides. The reason why the body engaging member 120 protrudes at one side or both sides is to provide manufacturing convenience and a functional effect of increasing or reducing the engaging force of the vertical frame 100 to be assembled in multiple stages. Herein, the body engaging members 120 protruding from the top surface of the body 110 at both sides are shown.

Since the body engaging member 120 protrudes from the top surface of the body 110 in the C-shape, the body engaging member 120 has the insertion groove 121 of which one side is opened. When the vertical frames 100 are assembled in multiple stages, the insertion groove 121 receives the body locking boss 140 formed on the bottom surface of the body 110, thereby fixing the vertical frames.

When the vertical frames 100 are assembled in multiple stages, the body engaging groove 130 is to guide the engaging position between the body locking boss 140 and the body engaging member 120. The body engaging groove 130 is recessed on the bottom surface of the body 110 in such a manner that one side is opened, at a position corresponding to the formation position of the body engaging member 120. As the circumferential surface of the body engaging member 120 is inserted along the inner surface of the body engaging groove 130 when the vertical frames 100 are assembled in multiple stages, the body locking boss 140 formed in the body engaging groove 130 is guided to fit into the insertion groove 121 of the body engaging member 120.

When the vertical frames 100 are assembled in multiple stages, the body locking boss 140 is fitted into the insertion groove 121 of the body engaging member 120, thereby fixing the vertical frames 100 to be assembled in multiple stages. The body locking boss 140 protrudes in a C-shape from the inside of the body engaging groove 130 at a position corresponding to the formation position of the insertion groove 121, and has the same diameter as that of the insertion groove 121 so that it can be locked when being fitted into the insertion groove 121. When the vertical frames 100 are assembled in multiple stages, the body engaging member 120 and the body locking boss 140 are engaged to each other, thereby preventing the vertical frames 100 assembled in multiple stages from being released by the engagement thereof.

A center fixing member 150 protrudes from the top surface of the body 110 at a center thereof so as to be engaged to the vertical frame 100 to be assembled in multiple stages by a rotation manner. The bottom surface of the body 110 is provided with a center member insertion hole 170 at a center thereof so that the center fixing member 150 is rotated and fitted into the center member insertion hole 170. The center fixing member 150 protrudes integrally from the center of the body in a cylindrical shape, and the center member insertion hole 170 is formed in the body 110 to correspond to the diameter of the center fixing member 150.

In the process of assembling the vertical frames 100 in multiple stages by use of the center fixing member 150 and the center member insertion hole 170, the center fixing member 150 of the vertical frame 100 positioned at the lower layer is fitted into the center member insertion hole 170 of the vertical frame 100 positioned at the upper layer, and the vertical frame 100 positioned at the upper layer is rotated around the center fixing member 150. The body engaging member 120 and the body locking boss 140 are engaged to each other by the rotation, so that it is not necessary for the user to align the positions of the body engaging member 120 and the body locking boss 140. Therefore, the engaging structure provides the use convenience.

An outer peripheral surface of the center fixing member 150 is provided with a center engaging groove 151 which is rounded in a direction opposite to the opened side of the insertion groove 121 of the body engaging member 120. A center engaging boss 171 protrudes from the inside of the center member insertion hole 170 at a position corresponding to the center engaging groove 151. In the process of assembling the vertical frames 100 in multiple stages, the center engaging groove 151 and the center engaging boss 171 guide the direction of the body locking boss 140 so that it is rotated in the opened direction of the insertion groove 121 of the body engaging member 120 by the engagement between the center engaging groove 151 and the center engaging boss 171.

Figure 3A:
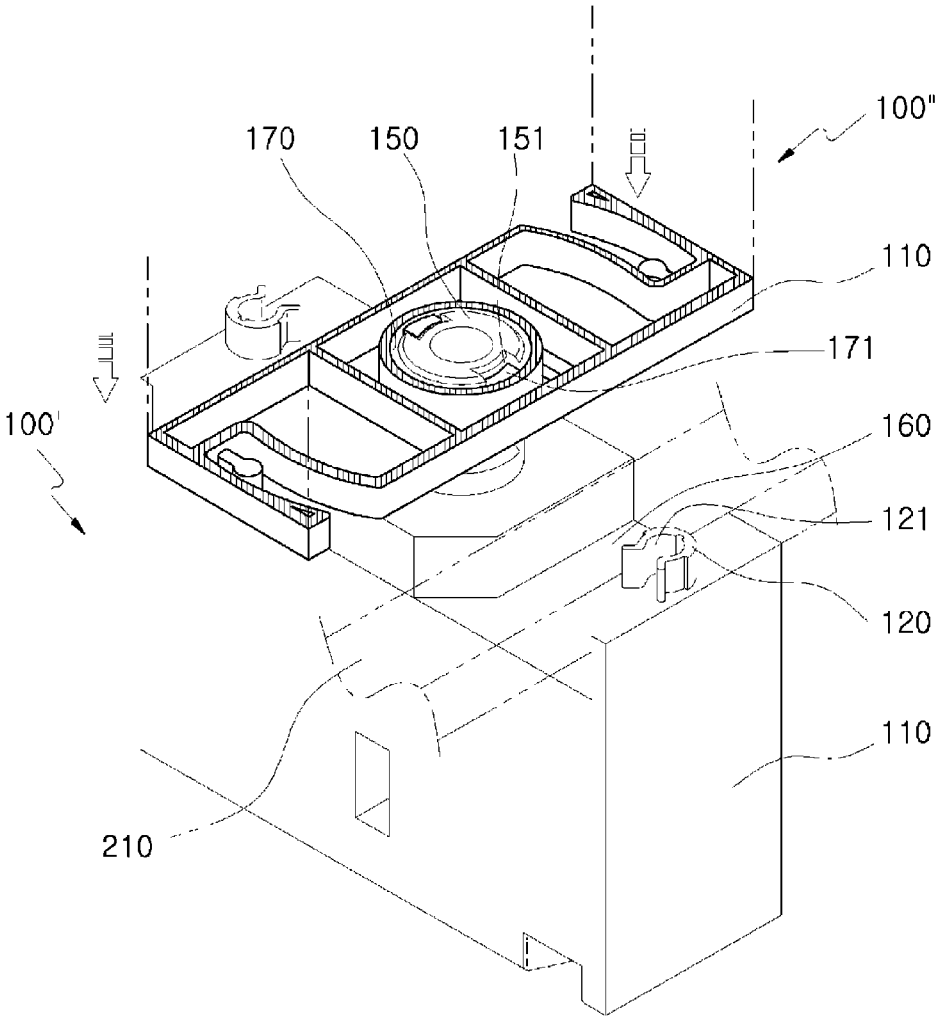
FIGS. 3*a* and 3*b* show views illustrating a process of assembling the vertical frame for the display stand according to the present invention.
Figure 3B:
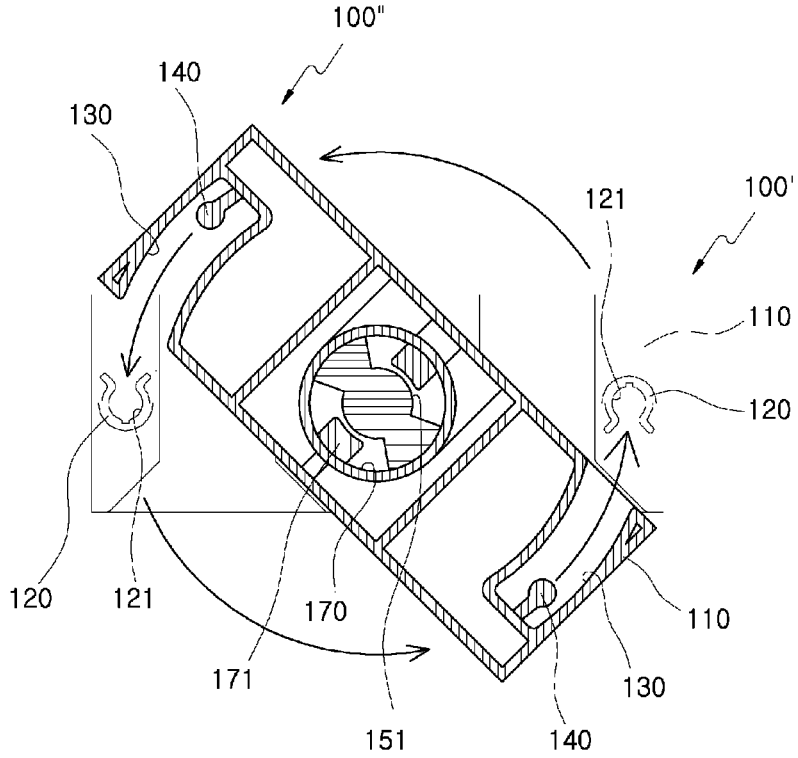

FIGS. 3*a* and 3*b* are views illustrating the process of assembling the vertical frames for the display stands according to the present invention.

FIG. 3*a* shows the state in which the vertical frames 100 configured as described above are assembled to each other in multiple stages. First, when the vertical frames 100 are assembled in multiple stages, the center member insertion hole 170 of the upper vertical frame 100" is fitted into the center fixing member 150 of the lower vertical frame 100' in the state in which the horizontal frame 210 of the shelf 200 is fitted into the shelf engaging groove 160 of the lower vertical frame 100', the center engaging boss 171 protruding from the center member insertion hole 170 of the upper vertical frame 100" is inserted into the insertion groove 121 formed on the outer peripheral surface of the center fixing member 150 of the lower vertical frame 100', so that the lower vertical frame 100' and the upper vertical frame 100" are stacked in the vertical direction.

FIG. 3*b* shows the state in which when the upper vertical frame 100" is positioned on the lower vertical frame 100', the lower vertical frame 100' and the upper vertical frame 100" are fixed to each other so that they are not separated. As the upper vertical frame 100" inserted into the center fixing member 150 of the lower vertical frame 100' is directly rotated around the center fixing member 150 by the user, the body locking boss 140 of the upper vertical frame 100" is fitted into insertion groove 121 of the lower vertical frame 100' by the center engaging groove 151 of the center fixing member 150. Therefore, the vertical frames 100 to be assembled in multiple stages are firmly fixed by the engagement between the body engaging member 120 and the body locking boss 140.

Herein, the lower vertical frame 100' and the upper vertical frame 100" are adopted to more clearly describe the assembling relation of the vertical frames, and thus are identical to the vertical frame 100 described above.

Therefore, since the vertical frame 100 for the prefabricated display stand 1 to store and display various articles includes the body 110 manufactured in the shape of the prefabricated block, the vertical frames 100 can be assembled in multiple stages by the engagement between the body engaging member 120 and the body locking boss 130 which are respectively formed on the top and bottom surfaces of the body 110. Therefore, the vertical interval of the prefabricated display stand 1 can be optionally adjusted, and since the volume of the disassembled vertical frames 100 is small, it is possible to easily transfer the disassembled display stand 1.

Also, since the top surface of the body of the vertical frame 100 is provided with the shelf engaging groove 160 to which the horizontal frame 210 of the shelf 200 is inserted and fixed, the engaging structure of the vertical frame 100 and the shelf 200 is very simple, thereby easily assembling the display stand 1. With the above structure, the number of parts of the prefabricated display stand 1 can be remarkably reduced, thereby lowering the manufacture cost of the prefabricated display stand 1.

Figure 4:
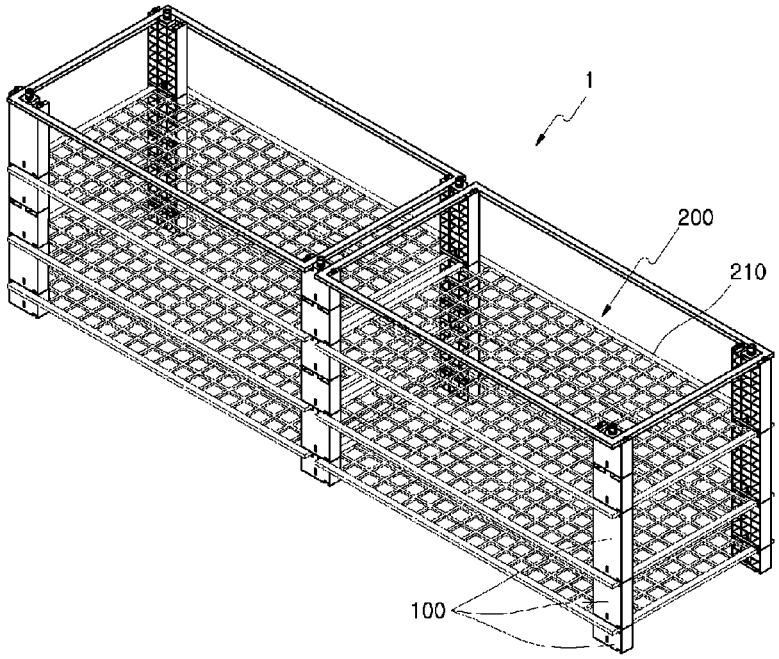
FIG. 4 is a view illustrating the vertical frame for the display stand according to the present invention.

FIG. 4 is a view illustrating the vertical frame for the display stand according to the present invention.

As illustrated in FIG. 4, the multipurpose prefabricated display stand 1 according to the present invention includes the vertical frames 100 of the block type which are respectively engaged to corner portions of the shelf 200 and are stacked to each other in multiple stages to support the overall load of the display stand 1, and the shelves 200 which are engaged to the vertical frames 100 in multiple stages to store and display various articles thereon.

The shelf 200 is formed in a rectangular frame, and has the horizontal frame 210 of a lattice type which is made of a metal material or synthetic resin. Since the shelf 200 is widely used for the display stand 1 to store and display various articles thereon, the shape and configuration of the shelf 200 may be modified in various ways, without changing the basic configuration of the rectangular horizontal frame 210.

The vertical frame 100 is engaged to each corner portion of the shelf 200 in such a way that the shelves are engaged to each other in multiple stages by positioning the horizontal frame 210 of the shelf 200 on the top surface of the body 110 which is assembled to each other in multiple stages. The body 110 can be manufactured so that the vertical height thereof is optionally selected by the user. Therefore, the vertical interval of the shelves 200 engaged to each other in multiple stages can be freely adjusted, thereby storing and displaying various articles of different sizes on one display stand 1. Since the display stand 1 is assembled by the vertical frames 100 which are assembled in multiple stages, it is possible to easily assemble and transfer the prefabricated display stand 1.

Since the configuration of the vertical frame 100 has been described in detail, the description will not be repeated.

Figure 5:
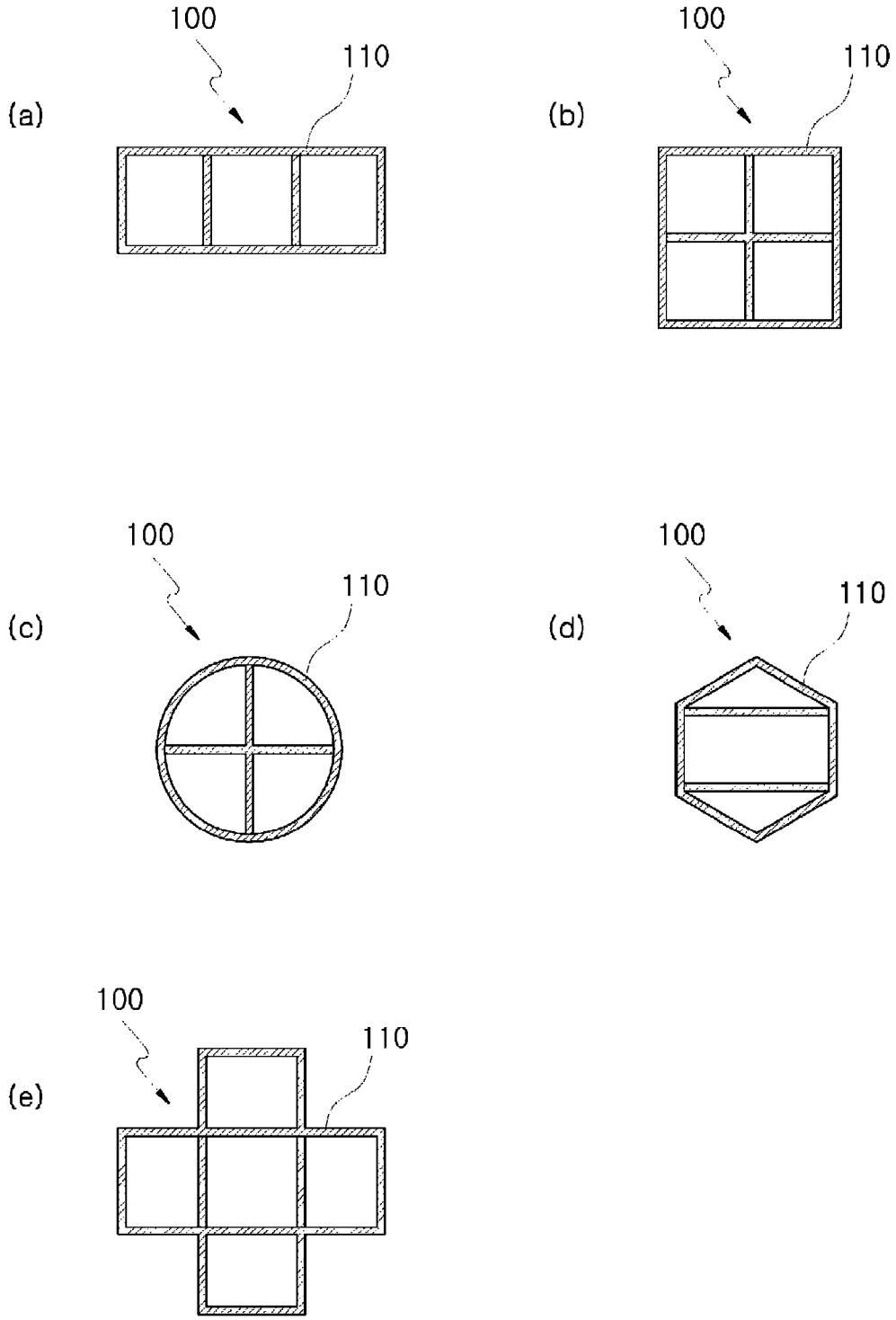
FIG. 5 is a plan view of a vertical frame according to another embodiment.

FIG. 5 is a plan view of a vertical frame according to another embodiment.

As illustrated in FIG. 5, the cross-sectional shape of the vertical frame 100 may have any one of a rectangle, a square, a circle, a polygon, and a cross according to selection of the user. As the vertical frame 100 can be formed to have any cross-sectional shape, the esthetic sense of the prefabricated display stand 1 can be shown in various ways.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

According to the vertical frame for the display stand and the multipurpose prefabricated display stand using the same, the body of the vertical frame is manufactured in the shape of the prefabricated block, and then is assembled in multiple stages by mutually engaging the body engaging member which is formed on the top surface of the body and the body locking boss which is formed on the bottom surface of the body, thereby optionally adjusting the vertical height of the prefabricated display stand and the interval of the shelves, as well as easily transporting parts of the disassembled display stand, and a multipurpose prefabricated display stand using the same. Also, since, the engaging structure of vertical frames and shelves are very simple, the display stand has advantages in which the display stand can be easily assembled, the number of parts for the display stand can be remarkably reduced, and a manufacture cost thereof can be lowered.

The invention claimed is:

1. A multipurpose prefabricated display stand comprising:

a plurality of shelves formed in a rectangular frame to store and display various articles thereon; and a vertical frame engaged to each corner portion of a first shelf of the plurality of shelves in such a way that the shelves are engaged to each other in multiple stages, wherein the vertical frame includes:

a first body which is formed in a shape of a prefabricated block and is assembled to a second body in multiple stages to support the shelves, a vertical length of each of the bodies being optionally adjusted by selection of a user;

a body engaging member which protrudes upwardly from both sides or one side of a top surface of the second body, and has an insertion groove of which one side is opened;

a body engaging groove which is formed on a bottom surface of the first body at a position corresponding to a formation position of the body engaging member, so as to guide the body engaging member of the second body and a body locking boss of the first body to an engaging position; and the body locking boss which protrudes from the body engaging groove and is fitted into the insertion groove when the bodies are assembled to each other in multiple stages, thereby fixing the respective bodies to be assembled to each other in multiple stages.

* * * * *